US005577487A

United States Patent [19]

Ohtake et al.

[11] Patent Number: 5,577,487

[45] Date of Patent: Nov. 26, 1996

[54] AIRCRAFT PISTON ENGINE CONTROL SYSTEM

[75] Inventors: Yukio Ohtake, Susono; Atsushi Watanabe, Shizuoka, both of Japan

[73] Assignee: Toyota Jidosha Kabushiki Kaisha, Aichi, Japan

[21] Appl. No.: 540,691

[22] Filed: Oct. 11, 1995

[30] Foreign Application Priority Data

Oct. 13, 1994 [JP] Japan ..... 6-247988
Jun. 22, 1995 [JP] Japan ..... 7-156055

[51] Int. Cl.[6] ..... F02B 75/08
[52] U.S. Cl. ..... 123/679
[58] Field of Search ..... 123/679, 682, 123/481, 434, 672, 478

[56] References Cited

U.S. PATENT DOCUMENTS

| | | | |
|---|---|---|---|
| 702,416 | 2/1885 | Goulet | 123/679 |
| 4,003,350 | 1/1977 | Eisele et al. | 123/679 |
| 5,115,781 | 5/1992 | Kurita et al. | 123/481 |
| 5,253,630 | 10/1993 | Akazaki et al. | 123/682 |
| 5,381,775 | 1/1995 | Birk et al. | 123/679 |

FOREIGN PATENT DOCUMENTS

| | | | |
|---|---|---|---|
| 51-247863 | 11/1986 | Japan | 123/679 |

OTHER PUBLICATIONS

New Aeronautics Lecture, vol. 6, An Air Craft Piston Engine.

*Primary Examiner*—Raymond A. Nelli
*Attorney, Agent, or Firm*—Kenyon & Kenyon

[57] ABSTRACT

An aircraft piston engine control system according to the present invention has a fuel supply passage for supplying fuel to the engine. A fuel regulation device is arranged in the fuel supply passage, is linked to a throttle lever, and regulates an amount of fuel so as to realize a first air-fuel ratio which is more rich than the stoichiometric air-fuel ratio. A fuel decreasing passage is connected to the fuel supply passage between the fuel regulation device and the engine. A fuel decreasing device is arranged in the fuel decreasing passage, and decreases an amount of fuel regulated by the fuel regulation device so as to realize an optimum air-fuel ratio according to the current engine operating condition.

36 Claims, 16 Drawing Sheets

AIRCRAFT PISTON ENGINE CONTROL SYSTEM

BACKGROUND OF THE INVENTION

1. Field of the Invention

The present invention relates to an aircraft piston engine control system.

2. Description of the Related Art

In an aircraft piston engine, the amount of fuel supplied to the engine and the ignition time are usually controlled by mechanical control systems. However, the document "NEW AERONAUTICS LECTURE vol. 6, AN AIRCRAFT PISTON ENGINE (issued by Japan Aeronautics Society)" discloses that these parameters can be controlled by electronic control systems which include sensors, to simplify the operation of the aircraft and to realize the optimum control thereof according to the current engine operating condition.

In general, electronic control system cause trouble more easily than the mechanic control system. Accordingly, to use the electronic control system in the aircraft engine which requires very high reliability, the electronic control system must be doubled, and a further control device is needed to detect any trouble in one electronic control and to change one electronic control system to the other electronic control system. Therefore, to use the electronic control system in the aircraft engine is very complicated and can cause a large cost increase.

SUMMARY OF THE INVENTION

Therefore, a first object of the present invention is to provide an aircraft piston engine control system, capable of realizing the optimum control of the amount of fuel supplied to the aircraft engine according to the current engine operating condition, with high reliability and without a large cost increase.

Moreover, a second object of the present invention is to provide an aircraft piston engine control system, capable of realizing the optimum control of the ignition time in the aircraft engine according to the current engine operating condition, with high reliability and without a large cost increase.

According to the present invention there is provided an aircraft piston engine control system comprising: a fuel supply passage for supplying fuel to the engine; a fuel regulation device, which is arranged in the fuel supply passage, and which is linked to a throttle lever, and which regulates an amount of fuel so as to realize a first air-fuel ratio which is more rich than the stoichiometric air-fuel ratio; a detection means for detecting a current engine operating condition; a fuel decreasing passage which is connected to the fuel supply passage between the fuel regulation device and the engine; and a fuel decreasing means, which is arranged in the fuel decreasing passage, and which decreases an amount of fuel regulated by the fuel regulation device so as to realize an optimum air-fuel ratio according to the current engine operating condition detected by the detection means.

Moreover, according to the present invention there is provided an aircraft piston engine control system comprising: a fuel supply passage for supplying fuel to the engine; a fuel regulation device, which is arranged in the fuel supply passage, and which is linked to a throttle lever, and which regulates an amount of fuel so as to realize a second air-fuel ratio which is more lean than the stoichiometric air-fuel ratio; a detection means for detecting a current engine operating condition; a fuel increasing passage which is connected to the fuel supply passage between the fuel regulation device and the engine; and a fuel increasing means, which is arranged in the fuel increasing passage, and which increases an amount of fuel regulated by said fuel regulation device so as to realize an optimum air-fuel ratio according to the current engine operating condition detected by the detection means.

Moreover, according to the present invention there is provided an aircraft piston engine control system comprising: a normally-closed breaker which is mechanically opened to synchronize to the crank shaft so as to generate a high-voltage for ignition; a normally-closed first switch connected to the breaker in series; a detection means for detecting a current engine operating condition; and a first switch control means which opens said first switch at an optimum ignition time according to the current engine operating condition detected by the detection means before the breaker is opened.

The present invention will be more fully understood from the description of preferred embodiments of the invention set forth below, together with the accompanying drawings.

DESCRIPTION OF THE PREFERRED EMBODIMENTS

Figure 1:
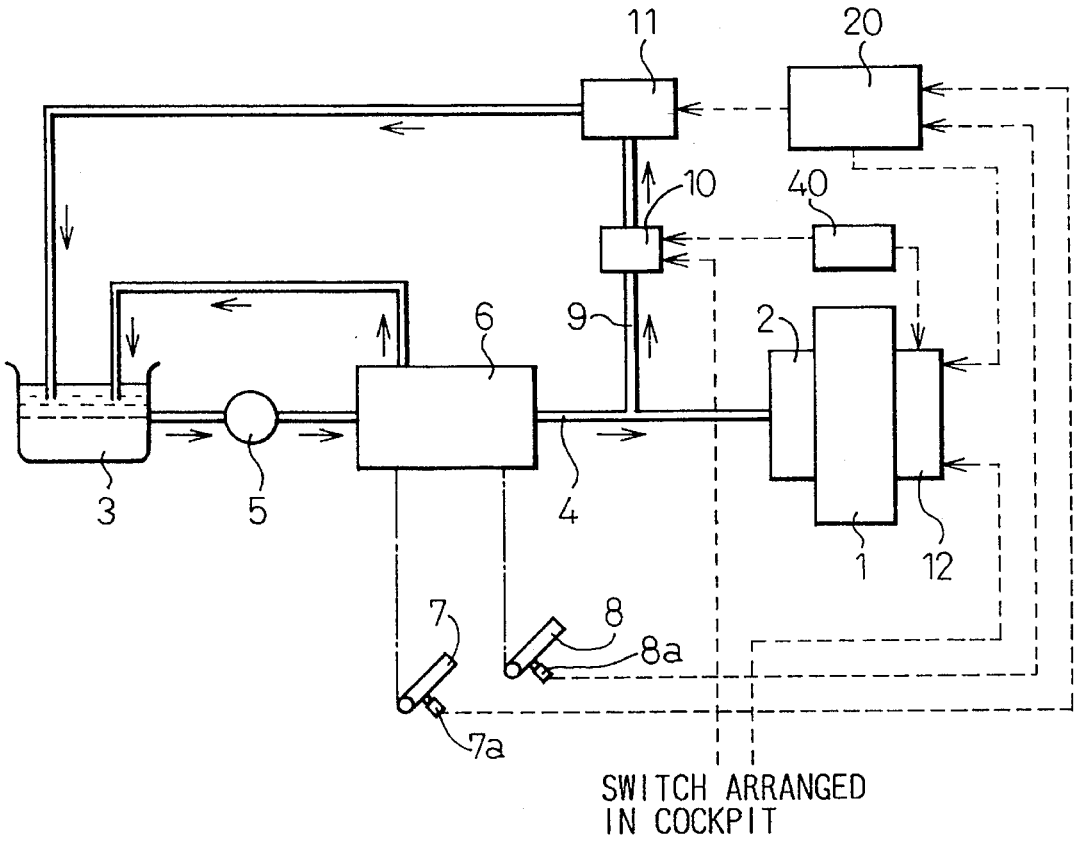
FIG. 1 is a sectional view schematically showing an aircraft piston engine control system according to the first embodiment of the present invention.

FIG. 1 is a view schematically showing aircraft piston engine control systems, according to a first embodiment of the present invention. In this figure, reference numeral 1 is an aircraft piston engine and reference numeral 2 is a fuel delivery valve connected to each fuel injector (not shown) with which each cylinder of the engine 1 is provided. The fuel delivery valve 2 is connected to a fuel tank 3, via a fuel supply passage 4. In the fuel supply passage 4, a fuel pump 5 is arranged and a fuel regulation device 6 is also arranged downstream thereof.

Figure 2:
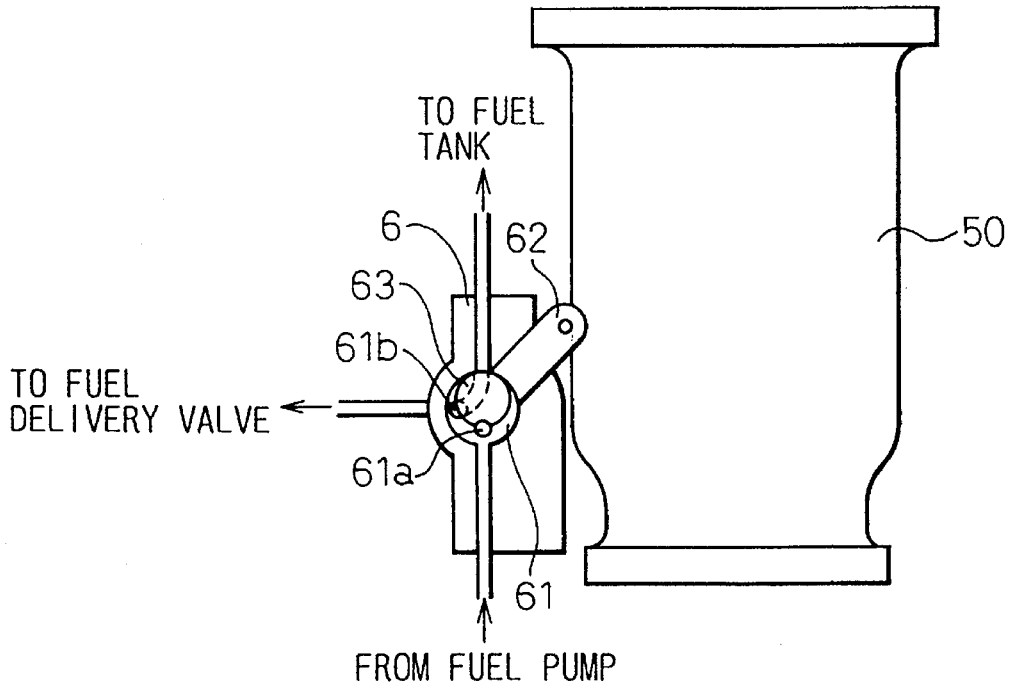
FIG. 2 is a schematic view of the vicinity of the intake passage showing the construction of the fuel regulation device.
Figure 3:
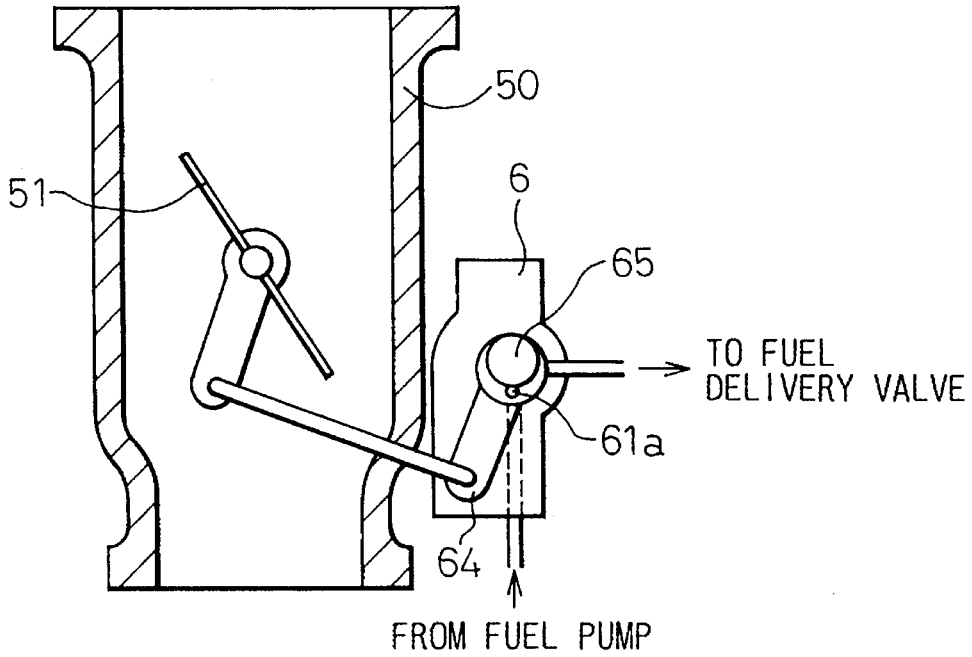
FIG. 3 is a schematic sectional view from the opposite side of FIG. 2.

The fuel regulation device 6 is usual. As shown in FIG. 2, it is arranged at the vicinity of the intake passage 50 of the engine 1 and has a metering plug 61. In the fuel regulation device 6, spaces are formed on both sides of the metering plug 61. The first space is connected to the fuel pump 5. The second space is connected to the fuel delivery valve 2. In the metering plug 61, a fuel passage 61*a* by which the first and second spaces are communicated each other is formed. Moveover, a fuel return passage 61*b* which is connected to the tank 3 and which opens on the first space is also formed. In the first space, a first throttle member 63 for throttling the openings of the fuel passage 61*a* and the fuel return passage 61*b* is arranged. The first throttle member 63 is pivoted by a first lever 62 which is linked to an air-fuel ratio control lever 7 arranged in the cockpit of aircraft. In the second space, a second throttle member 65 for throttling the opening of the fuel passage 61*a* is arranged, as shown in FIG. 3. The second throttle member 65 is pivoted by a second lever 64 which is linked to a throttle valve 51 which is arranged in the intake passage 50 and which is mechanically actuated by a throttle lever 8 arranged in the cockpit.

The fuel regulation device 6 can regulate the amount of the compressed fuel supplied from the fuel pump 5 to the fuel delivery valve 2 according to the degree of the opening of the throttle valve 51 regulated by the throttle lever 8, i.e., the amount of intake air so as to realize the desired air-fuel ratio designated by the air-fuel ratio control lever 7.

Referring to FIG. 1, a fuel decreasing passage 9 which is connected to the fuel tank 3 is connected to the fuel supply passage 4 between the fuel regulation device 6 and the fuel delivery valve 2. In the fuel decreasing passage 9, a shut-off valve 10 is arranged and a control valve 11 is also arranged downstream thereof. The shut-off valve 10 is a normally-open electromagnetic valve, and can open or close the fuel decreasing passage 9. 0n the other hand, the control valve 11 is an electromagnetic valve which valve member is biased toward the close position by a spring, etc., and can regulate the opening of the valve member according to the voltage supplied thereto.

Figure 4:
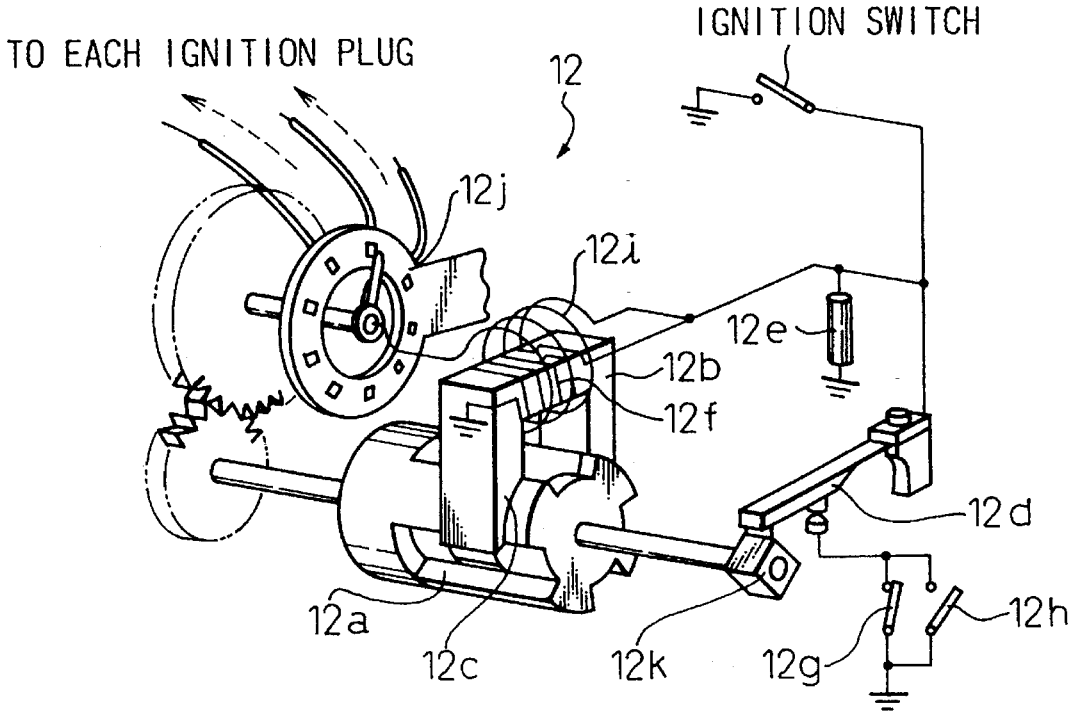
FIG. 4 is a schematic view of the high-voltage magnet system.

Reference numeral 12 is a high-voltage magnet system to supply ignition voltage to an ignition plug provided in every cylinder of the engine 1. FIG. 4 is a construction view of the high voltage magnet system 12. In this figure, reference numeral 12*a* is a rotary magnet actuated by the crank shaft of the engine 1. In the rotary magnet 12*a*, N pole members and S pole member are arranged alternately. Reference numeral 12*b* is an iron core for primary coil 12*f*. Reference numeral 12*c* is pole shoes. These members construct a magnetic circuit. One end of the primary coil 12*f* is connected to the iron core 12*b*. The other end of the primary coil 12*f* is connected to one contact point of a breaker 12*d*. The other contact point of the breaker 12*d* is connected to the earth via first and second switches 12*g*, 12*h* arranged in a row. The first switch 12*g* is normally-closed. The second switch 12*h* is normally-open. A capacitor 12*e* is arranged in a row against the breaker 12*d*. These members construct a primary current circuit. Reference numeral 12*i* is secondary coil which is wound about the primary coil 12*f*. One end of the secondary coil 12*i* is connected to a distributor 12*j*. The other end of the secondary coil 12*i* is connected to the other end side of the primary coil 12*f*. These construct a secondary current circuit. As the first and second switches 12*g*, 12*h*, a transistor or a two-way switch can be used.

The high-voltage magnet system 12 can generate a high-voltage current in the secondary current circuit to cause a spark at the ignition plug, once the contact of the breaker 12*d* is opened at ignition time of each ignition plug by a cam 12*k* rotated with the crank shaft and thus the current is interrupted on the primary current circuit.

Figure 5:
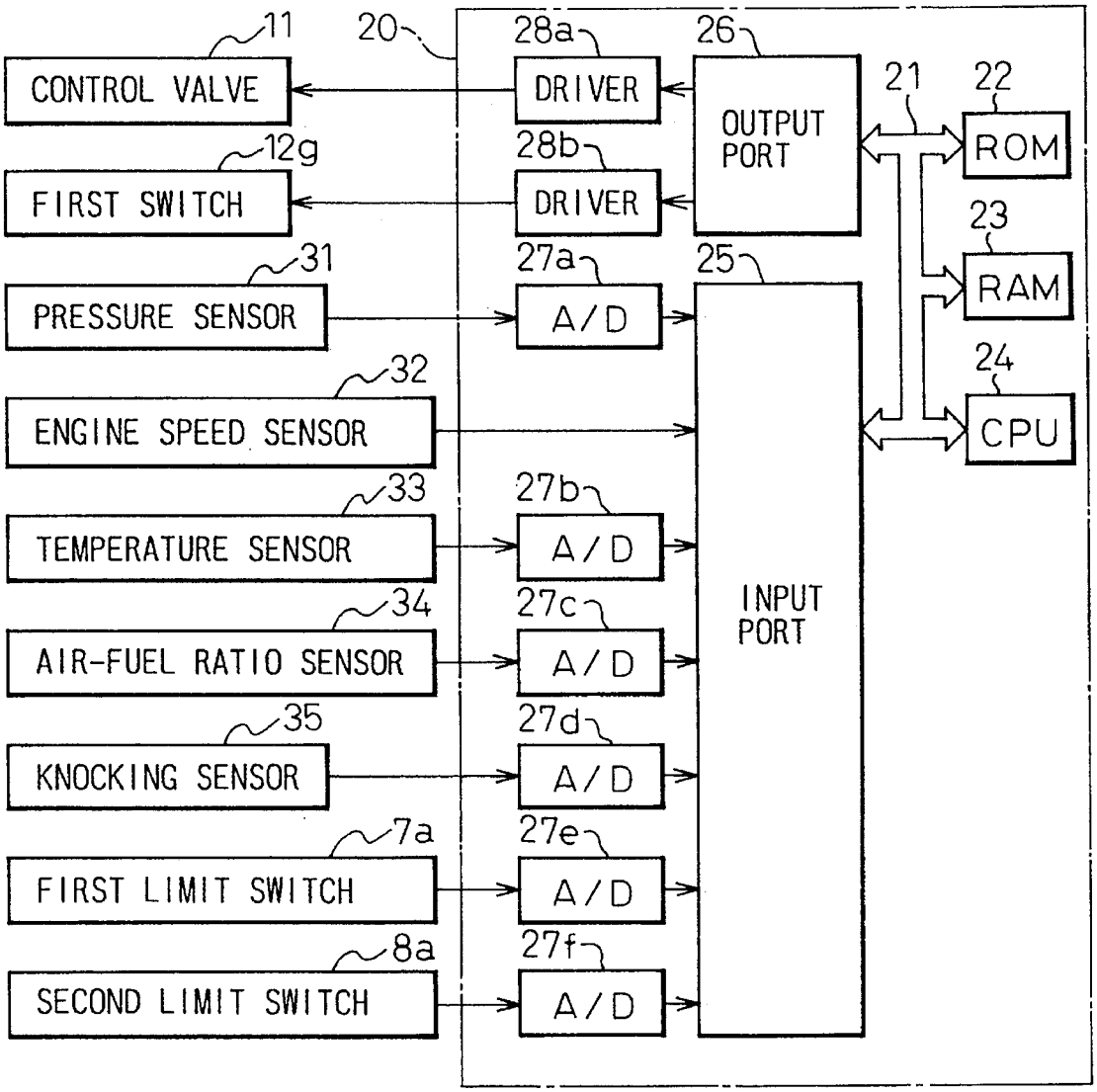
FIG. 5 is a schematic view of the ECU shown in FIG. 1.

Referring to FIG. 1, reference numeral 20 is an electronic control unit for controlling the control valve 11 in the fuel decreasing passage 9 and the first switch 12*g* of the high-voltage magnet system 12. As shown in FIG. 5, the ECU 20 is constructed as a digital computer and includes a ROM (read only memory) 22, a RAM 10 (random access memory) 23, a CPU (microprocessor, etc.) 24, an input port 25, and an output port 26. The ROM 22, the RAM 23, the CPU 24, the input port 25, and the output port 26 are interconnected by a bidirectional bus 21.

A pressure sensor 31 for detecting the pressure (PM) in the intake passage 50 downstream of the throttle valve 51 as the amount of intake air is connected to the input port 25, via an AD converter 27*a*. An engine speed sensor 32 for detecting the engine speed (NE) is connected to the input port 25. A temperature sensor 33 for detecting the temperature (THW) of the cooling water of the engine 1 as the engine temperature is connected to the input port 25, via an AD converter 27*b*. An air-fuel ratio sensor 34 which is arranged in the exhaust passage and which produces an output voltage representing the air-fuel ratio of the mixture according to the oxygen content of the exhaust gas is connected to the input port 25, via an AD converter 27*c*. A knocking sensor 35 for detecting knocking occurring in any engine cylinder on the basis of vibration caused thereby, etc., is connected to the input port 25, via an AD converter 27*d*. Moreover, a first limit switch 7*a* and a second limit switch 8*a* are connected to the input port 25, via AD converters 27*e*, 27*f*. On the other hand, the control valve 11 and the first switch 12*g* are connected to the output port 26, via AD converters 28*a* and 28*b*, respectively.

Figure 6:
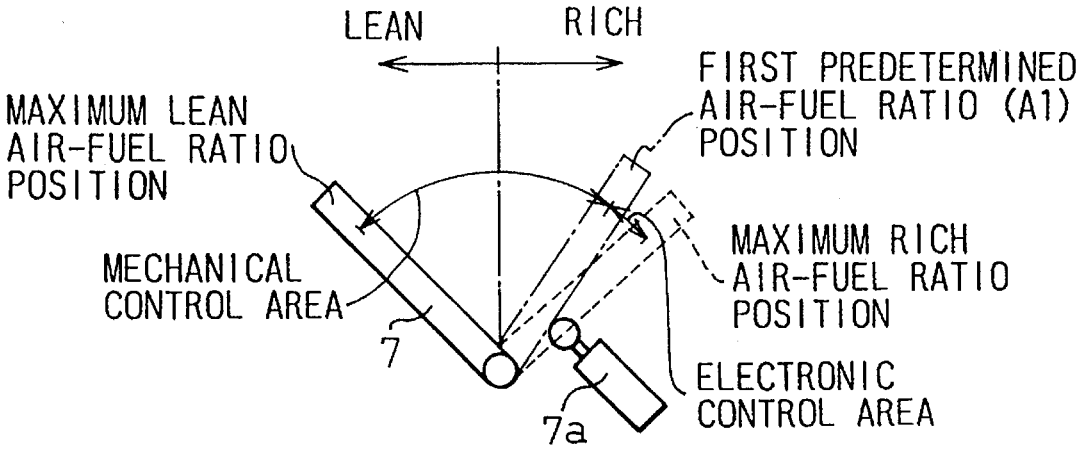
FIG. 6 is a view for explaining the air-fuel ratio control lever.
Figure 7:
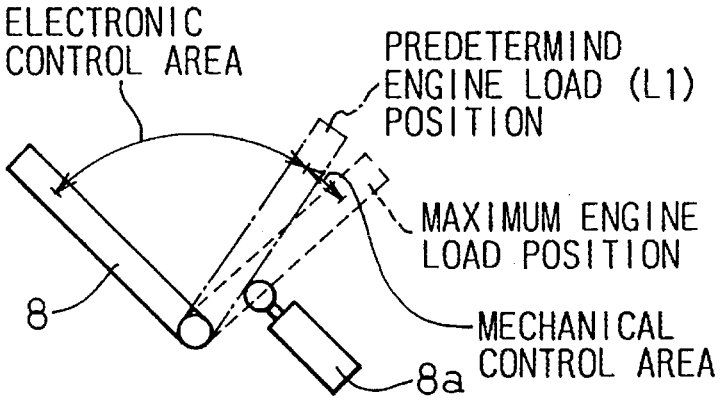
FIG. 7 is a view for explaining the throttle lever.

As shown in FIG. 6, the first limit switch 7*a* is closed only when the air-fuel ratio control lever 7 is in the area more rich than a first predetermined air-fuel ratio (A1) near the maximum rich air-fuel ratio. As shown in FIG. 7, the second limit switch 8*a* is opened only when the throttle lever 8 is in the area with a higher engine load than a predetermined engine load (L1) near the maximum engine load.

Figure 8:
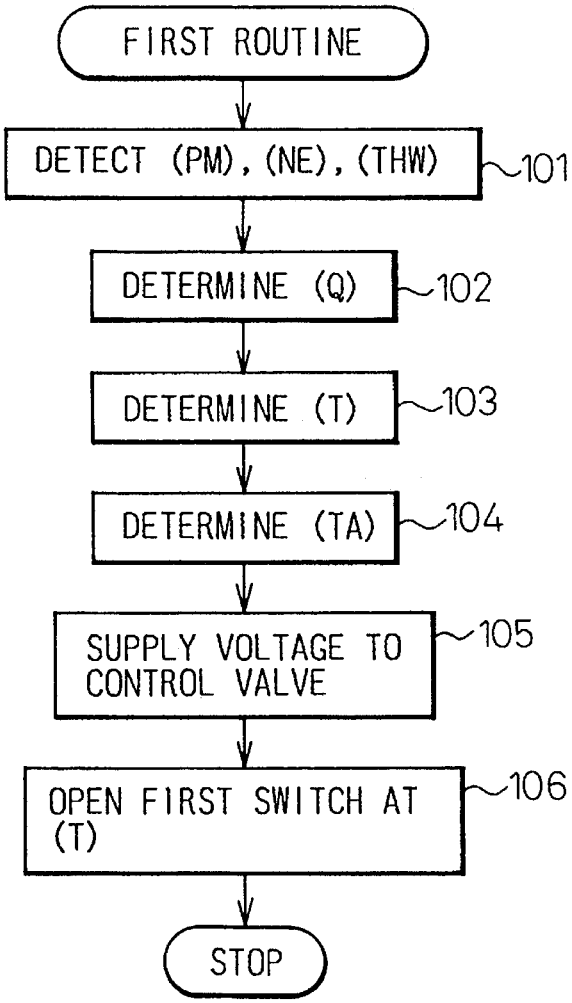
FIG. 8 is a first routine for the electronic engine control.
Figure 9:
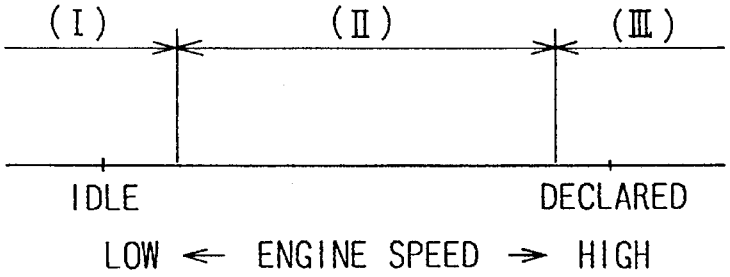
FIG. 9 is a map for showing each engine speed area.

The ECU 20 carries out the above-mentioned two controls electronically, according to a first routine shown in FIG. 8. Referring to FIG. 8, at step 101, a current pressure (PM) in the intake passage 50, a current engine speed (NE), and a current temperature (THW) of the cooling water are detected by the above-mentioned sensors 31, 32, 33. The routine goes to step 102 and an optimum amount of fuel (Q) supplied to the engine 1 in the current engine operating condition is determined by the use of a three-dimensional map (not shown), etc., on the basis of these values (PM), (NE), (THW). The routine goes to step 103 and an optimum ignition time (T) in the current engine operating condition is determined by use of a three-dimensional map (not shown), etc., on the basis of these values (PM), (NE), (THW). The map for determining an optimum amount of fuel (Q) is set such that the air-fuel ratio of mixture is made lean only in middle engine speed operating conditions (II) as shown in FIG. 9. This is because, if the air-fuel ratio of mixture is made lean in middle engine speed operating conditions (II) it does not cause the engine speed to become unstable as in low engine speed operating conditions (I) or the temperature of exhaust gas becomes very high as in high engine speed operating conditions (III). Thus, the optimum amount of fuel (Q) in each engine operating condition is actually supplied to the engine cylinders, fuel consumption can be improved in middle engine speed operating conditions.

Next, at step 104, when an amount of fuel regulated in the fuel regulation device 6 by the air-fuel ratio control lever 7 and the throttle lever 8 is more than the current optimum amount of fuel, a degree (TH) of opening of the control valve 11 is determined so as to return the extra amount of fuel to the fuel tank 3 and to supply the optimum amount of fuel to the engine cylinders. The routine goes to step 105 and the control valve 11 is supplied a voltage for realizing the degree (TH) of opening. Next, at step 106, when the current optimum ignition time (T) is earlier than a predetermined ignition time, i.e., a contact opening time of the breaker 12*d*, the first switch 12*g* is opened at the current optimum ignition time (T) so that the ignition can be carried out at the current optimum ignition time and thus the engine torque can be increased in each engine operating condition.

Figure 10:
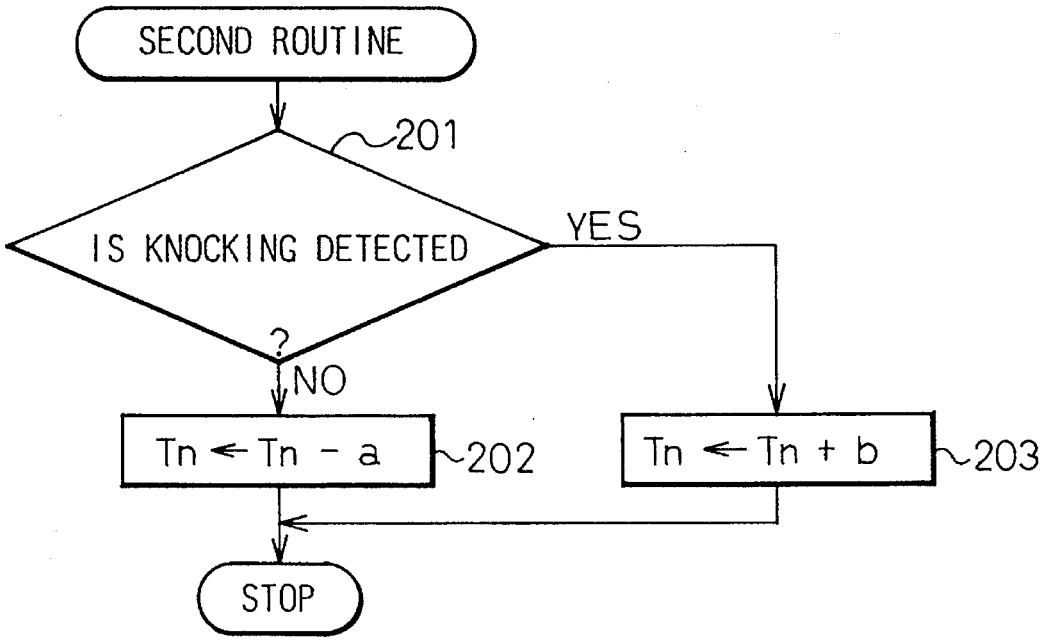
FIG. 10 is a second routine for the ignition time feed-back control.

In connection with the ignition time control, instead of the above-mentioned control, a second routine for a feed-back ignition time control shown in FIG. 10 can be carried out by the ECU 20. The second routine is explained as follows. At step 201, it is determined whether or not knocking is detected in at least one of cylinders by the knocking sensor 35. When the determination is negative, the routine goes to step 202 and the current ignition time (Tn) is made early by a predetermined small crank angle (a) and at this ignition time (Tn–a), the first switch 12*g* is opened. On the other hand, when the determination at step 201 is affirmative, the routine goes to step 203 and the current ignition time (Tn) is made late by a predetermined crank angle (b) and at this ignition time (Tn +b), the first switch 12*g* is opened. Thus, the ignition time can be carried out at the knocking limit in each engine operating condition so that the engine torque can be made high. In the second routine, the three sensors 31, 32, 33 for detecting the current engine operating condition are not required and thus the number of required sensors is reduced. Accordingly, the control can be simplified and the reliability thereof can be improved in contrast with the above-mentioned ignition time control.

In a circuit (not shown) for supplying a voltage to the control valve 11, two contacts of the first and second limit switches 7*a*, 8*a* are connected in series. Accordingly, when at least one the contacts is opened, a voltage is not supplied to the control valve 11 so that the fuel decreasing passage 9 is closed by the valve member of the control valve 11, which is biased toward the close position by the spring. The shut-off valve 10 may be closed when at least one of the contacts is opened.

Therefore, when the air-fuel ratio control lever 7 is in the area more lean than the first predetermined air-fuel ratio (A1) or when the throttle lever 8 is in the area with a higher engine load than the predetermined engine load (L1) and thus the high engine torque is required, the fuel decreasing passage 9 is closed by the control valve 11 or the shut-off valve 10 so that the amount of fuel supplied from the fuel regulation device 6 is not decreased and thus the amount of fuel supplied to the engine 1 is mechanically controlled by the fuel regulation device 6 according to the intention of the pilot.

On the other hand, when the air-fuel control lever is in the area more rich than the first predetermined air-fuel ratio (A1) and the throttle lever 8 is in the area with a lower engine load than the predetermined engine load (L1), the degree of opening of the control valve 10 is electronically controlled as above-mentioned so that the extra amount of fuel above the optimum amount of fuel in the current engine operating condition is automatically returned to the fuel tank 3 and thus the engine operation with low fuel consumption can be realized without a manual air-fuel ratio control by the pilot. In the present embodiment, the air-fuel ratio control lever 7 also functions as a change lever for changing the electronic and mechanical amount of fuel controls.

Figure 11:
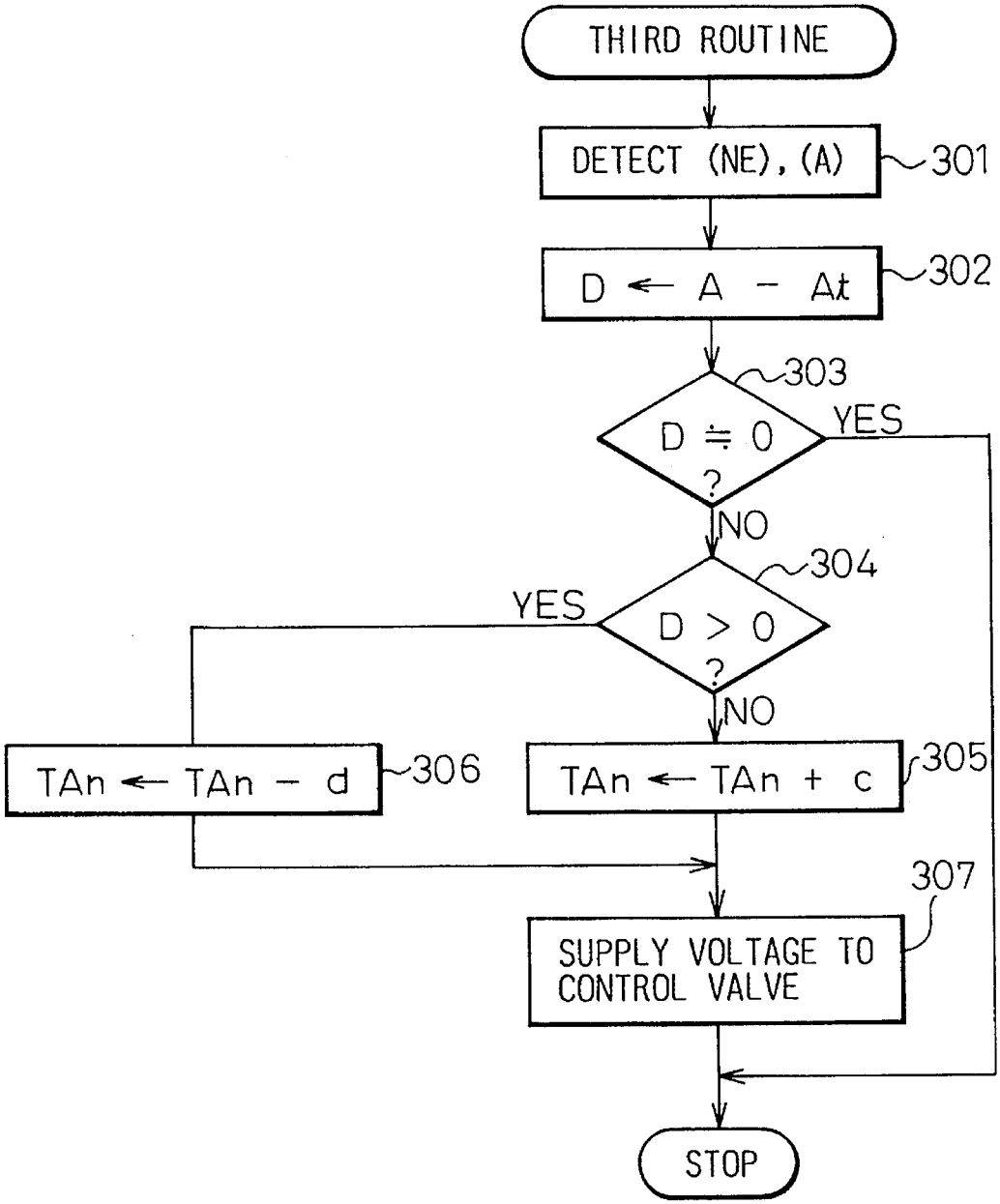
FIG. 11 is a third routine for the feed-back control of the control valve.

In connection with the amount of fuel control, if the optimum air-fuel ratio is constant in at least every engine operating condition (I), (II), (III) shown in FIG. 8, a third routine for feed-back control of the control valve 11 shown in FIG. 11 can be carried out by the ECU 20 instead of the above-mentioned control. The third routine is explained as follows. At step 301, a current engine speed (NE) and a current air-fuel ratio (A) are detected by the sensors 32, 34. Next, at step 302, a difference (D) between the current air-fuel ratio (A) and a desired constant air-fuel ratio (At) corresponding to the current engine speed (NE) is calculated. The routine goes to step 303 and it is determined whether or not the difference (D) is nearly equal to (0). When the determination is affirmative, the optimum amount of fuel is supplied to the engine 1 and the current degree of the opening of the control valve 11 is not changed. On the other hand, when the determination at step 303 is negative, the routine goes to step 304 and it is determined whether or not the difference (D) is larger than (0). When the determination is negative, the current air-fuel ratio is more rich than the desired constant air-fuel ratio (At) and the routine goes to step 305. The current degree of the opening (TAn) of the control valve is increased by a predetermined small degree of opening (c). On the other hand, when the determination at step 306 is affirmative, the current air-fuel ratio is more lean than the desired constant air-fuel ratio (At) and the routine goes to step 306. The current degree of the opening (TAn) of the control valve is decreased by a predetermined small degree of opening (d). Next, at step 307, the control valve 11 is supplied with a voltage for realizing the new degree (TAn) of the opening. Thus, the desired air-fuel ratio can be realized in each engine operating condition. In the third routine, the three sensors 31, 32, 33 for detecting the current engine operating condition are not required and thus the number of required sensors is reduced. Accordingly, the control can be simplified and the reliability thereof can be improved in contrast with the above-mentioned amount of fuel control.

In the aircraft engine control system of the present embodiment, if any trouble in such electronic control systems occurs, the fuel regulation device 6 and high-voltage magnet system 12 can mechanically control the amount of fuel supplied to the engine 1 and the ignition time and thus it is not required that each electronic control system is made double.

Moreover, to improve reliability, a device 40 for detecting any trouble in the electronic control systems is provided in the aircraft engine control system of the present embodiment, as shown in FIG. 1. If the device 40 detects any trouble in the electronic control systems, the shut-off valve 10 is supplied a voltage therefrom and the second switch 12*h* is closed thereby. Therefore, the fuel decreasing passage 9 is closed by the shut-off valve 10 and thus the amount of fuel supplied to the engine 1 is manually controlled by the fuel regulation device 6. The ignition occurs at the predetermined time due to the breaker 12*d*, in spite of the opening of the first switch 12*g*. If the device 40 does not detect any trouble in the electronic control systems, the fuel decreasing passage 9 may be closed by the shut-off valve 10 or the control valve 11 in low engine speed operating conditions (I) or in high engine speed operating conditions (III) of FIG. 9. Therefore, in low engine speed operating conditions (I), the air-fuel ratio does not become lean and thus the engine speed can surely be made stable, and in high engine speed operating conditions (III), the air-fuel ratio does not become lean and thus the high engine torque can be surely obtained.

Figure 12:
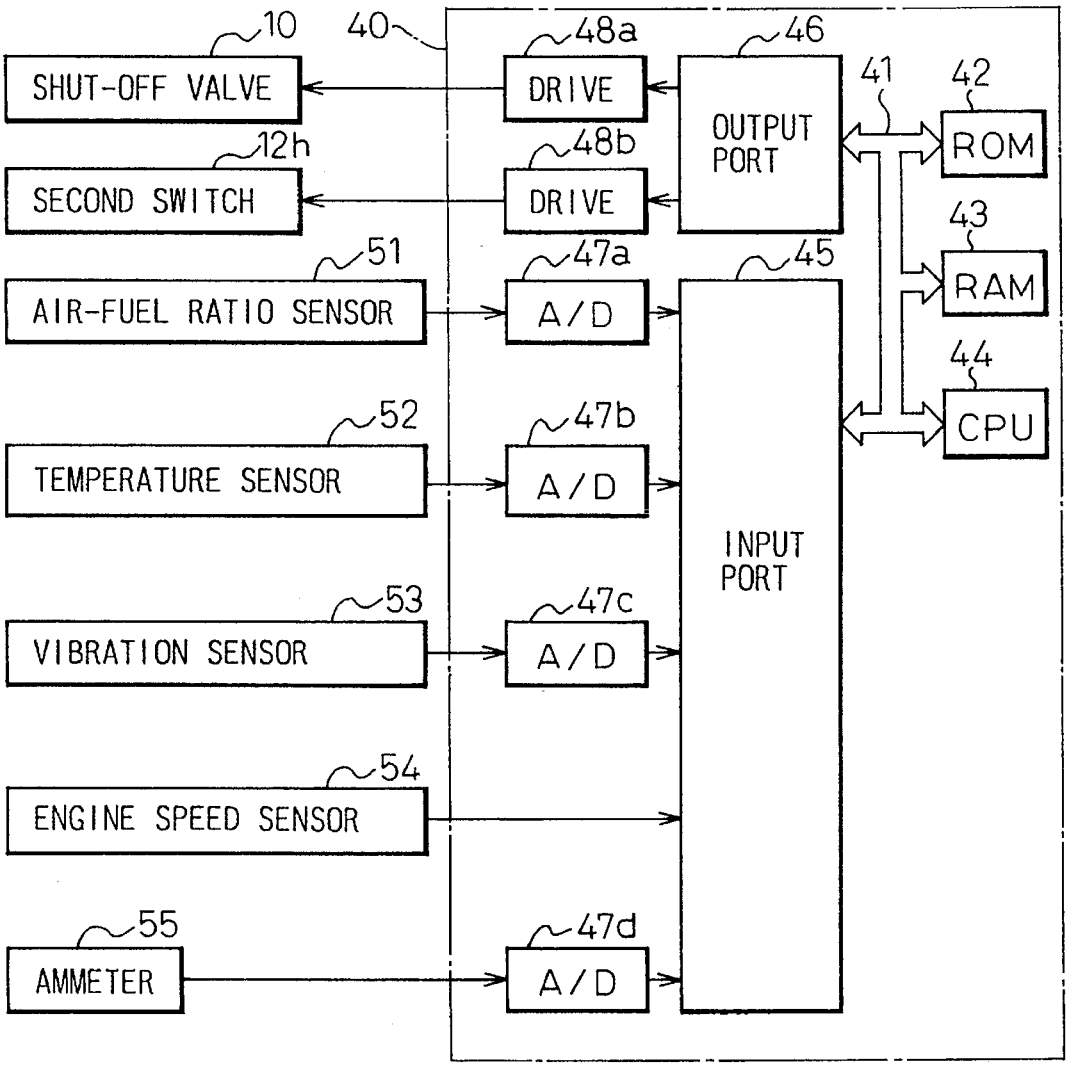
FIG. 12 is a schematic view of the device for detecting any trouble in the electronic control systems shown in FIG. 1.
Figure 13:
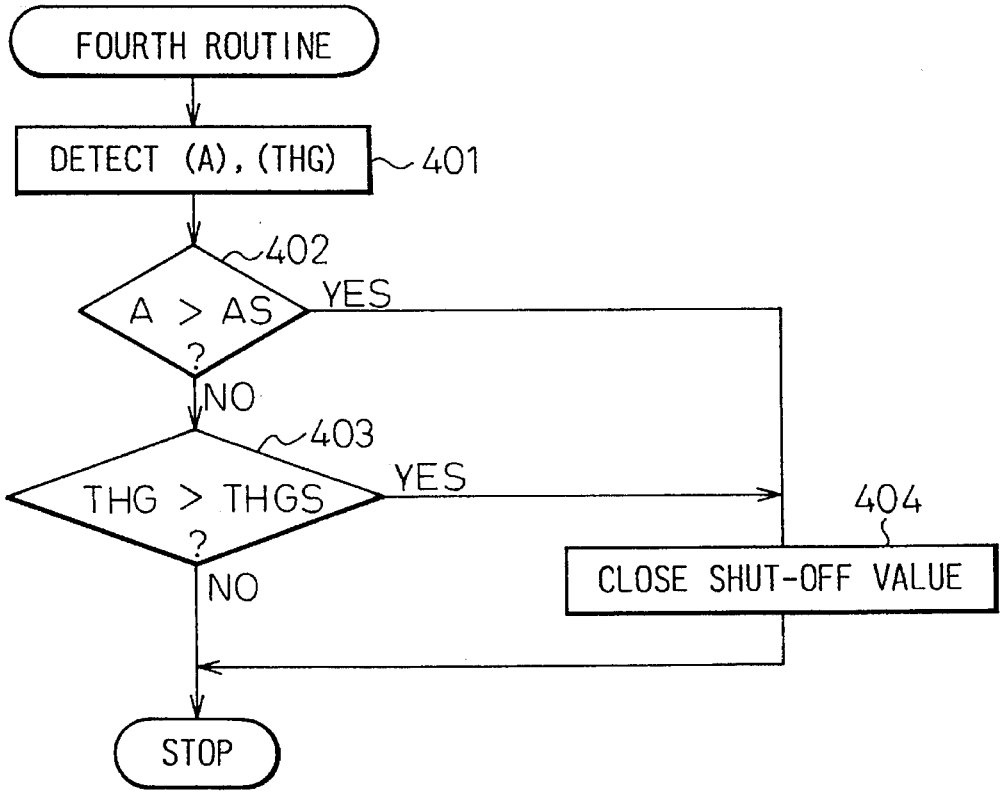
FIG. 13 is a fourth routine for detecting any trouble in the electronic amount of fuel control system.

As the device 40 for detecting any trouble in the electronic control systems, a digital computer as same as the ECU 20 can be used, as shown in FIG. 12. A temperature sensor 51 for detecting the temperature of exhaust gas, an air-fuel ratio sensor 52 which produces an output voltage representing the air-fuel ratio of mixture according to the oxygen content of the exhaust gas, a vibration sensor 53 for detecting engine vibration, an engine speed sensor 54, and an ammeter 55 for detecting a current on the secondary current circuit of the high-voltage magnet system 12 are connected to the input port 45 of the digital computer 40. The shut-off valve 10 and the second switch 12h are connected to the output port 46, via a drive 48*a*, 48*b*, respectively. The device 40 detects any trouble in the electronic amount of fuel control system according to a fourth routine shown in FIG. 13. In the fourth routine, at step 401, a current air-fuel ratio (A) and a current temperature (THG) of exhaust gas are detected by the sensors 51, 52. Next, at step 402, it is determined whether or not the current air-fuel ratio (A) is larger than a predetermined lean air-fuel (AS). When the determination is negative, the routine goes to step 403 and it is determined whether or not the current temperature (THG) of exhaust gas is higher than a predetermined temperature (THGS). When the determination is negative, no trouble occurs in the electronic amount of fuel control system and thus the routine is stopped. On the other hand, when the determination at step 402 or 403 is affirmative, i.e., the current air-fuel ratio (A) becomes very lean or very rich due to a trouble in the electronic amount of fuel control system, the routine goes to step 404 and the shut-off valve 404 is closed. As a sensor for detecting any trouble in the electronic amount of fuel control, a vibration sensor for detecting engine vibration can be used because engine vibration reduces if a misfire caused by too rich or lean air-fuel ratio occurs in at least one cylinder, or an engine speed sensor for detecting engine speed can be used because engine speed does not increase if a misfire caused by too rich or lean air-fuel ratio occurs in the combustion stroke of one cylinder.

Figure 14:
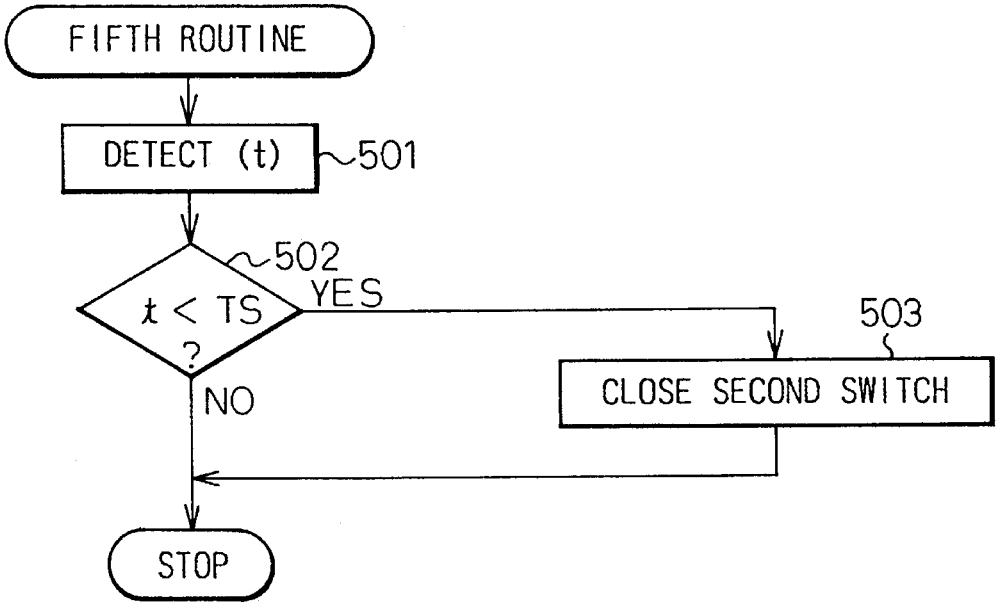
FIG. 14 is a fifth routine for detecting any trouble in the electronic ignition time control system.

On the other hand, the device 40 detects any trouble in the electronic ignition time control system according to a fifth routine shown in FIG. 14. In the fifth routine, at step 501, a current ignition time (t) is detected by the sensor 55. Next, at step 502, it is determined whether or not the current ignition time (t) is earlier than a predetermined ignition time (TS) which can cause preignition. When the determination is negative, the routine goes to step 503, no trouble occurs in the electronic ignition time control system and thus the routine is stopped. On the other hand, when the determination at step 502, i.e., the current ignition time (t) becomes very early due to trouble in the electronic ignition time control system, the routine goes to step 503 and the second switch 12*h* is closed.

To simplify the control of the device 40, when any trouble occurs in at least one electronic control system, both the amount of fuel control and the ignition time control may be changed from electronic to mechanical.

On the other hand, the pilot can judge that any trouble occurs in at least one electronic control system, on the basis of the current aircraft condition. In this case, the shut-off valve 10 and the second switch 12*h* can be closed by a switch arranged in the cockpit.

Figure 15:
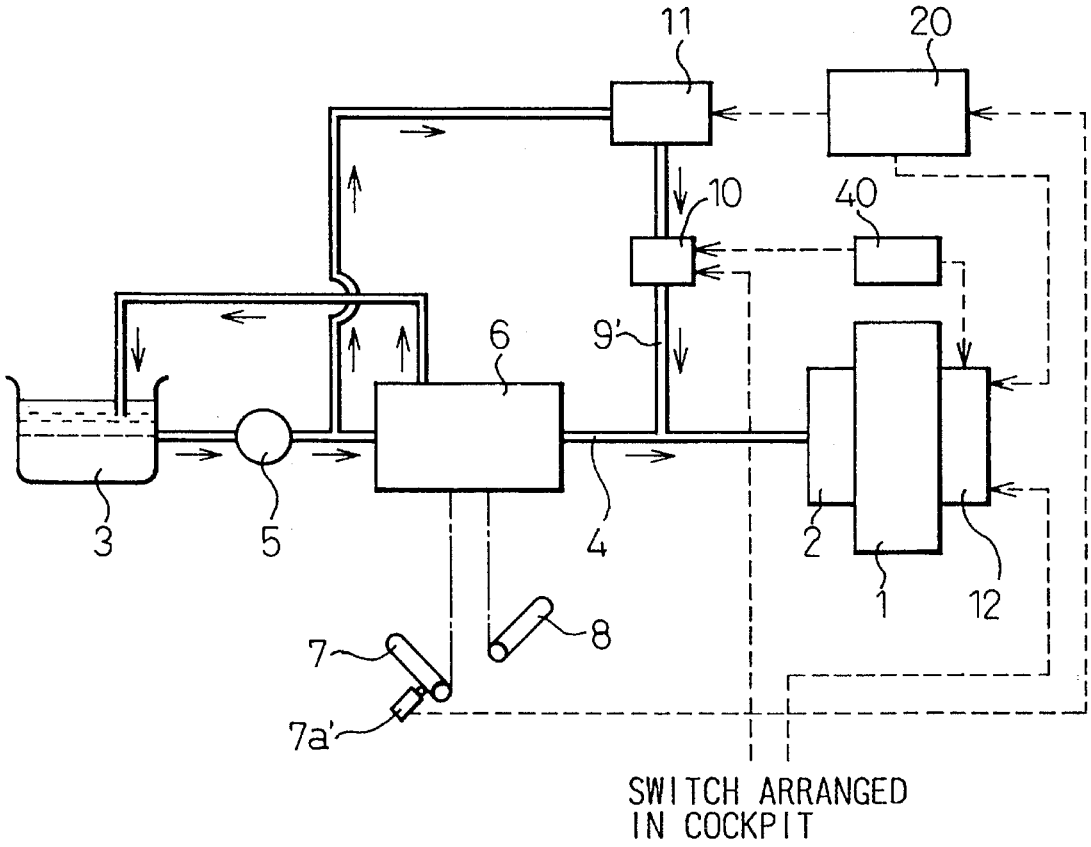
FIG. 15 is a sectional view schematically showing an aircraft piston engine control system, according to the second embodiment of the present invention.
Figure 16:
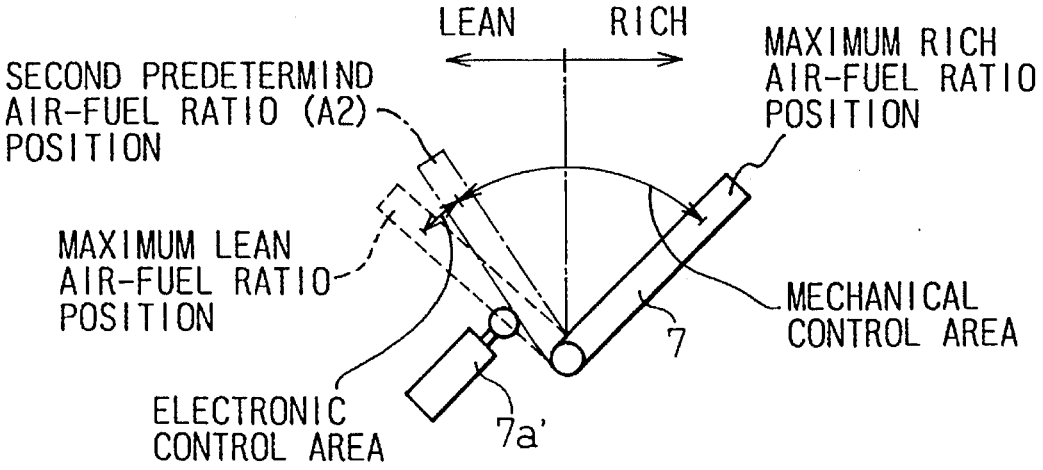
FIG. 16 is a view for explaining the air-fuel ratio control lever.

FIG. 15 is a view schematically showing aircraft piston engine control systems, according to a second embodiment of the present invention. Only the differences from the first embodiment will be explained. In the present embodiment, reference numeral 9' is a fuel increasing passage which bypasses the fuel regulation device 6 and which is connected to the fuel supply passage 4. As shown in FIG. 16, a limit switch 7*a*' is closed only when the air-fuel ratio control lever 7 is in the more lean area than a second predetermined air-fuel ratio (A2). Only the limit switch 7*a*' is connected to the input port of the ECU 20, instead of the limit switches 7*a*, 7*b*.

Figure 17:
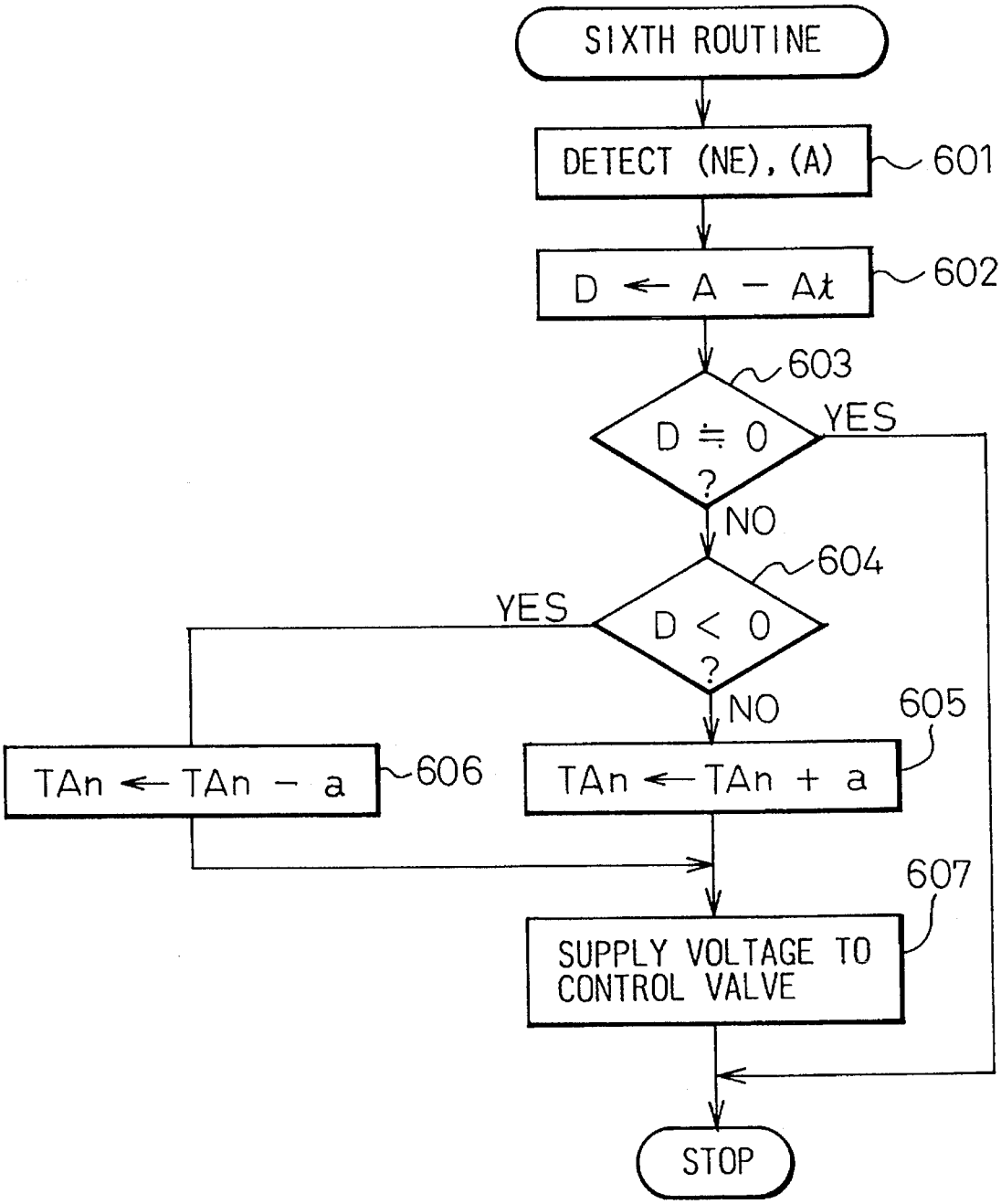
FIG. 17 is a sixth routine for the feed-back control of the control valve in FIG. 15.

In the aircraft piston engine control systems, if the air-fuel ratio control lever 7 is held in the area more lean than the second predetermined air-fuel ratio (A2), the fuel regulation device 6 regulates an amount of fuel so as to realize the lean air-fuel ratio indicated by the air-fuel ratio control lever 7, and the ECU 20 controls the control valve 11 and an amount of fuel is increased through the fuel increasing passage 9' so as to realize the optimum amount of fuel (Q) in the current engine operating condition, according to a routine the same as the first routine. Thus, as in the first embodiment, a good electronic amount of fuel control can be carried out. An electronic ignition time control in the present embodiment is carried out as same as the first embodiment. In connection with the amount of fuel control, if the optimum air-fuel ratio is constant in at least every engine operating condition (I), (II), (III) shown in FIG. 8, feed-back control of the control valve 11 can be carried out by the ECU 20, according to a sixth routine shown in FIG. 17. What is different from the third routine is that at step 604 it is determined whether or not the difference (D) is smaller than (0) in contrast with the third routine.

In the first embodiment, the air-fuel ratio control lever 7 can be omitted. In this case, the fuel regulation device 6 always regulates an amount of fuel so as to realize a predetermined rich air-fuel ratio, according to an amount of intake air. Such aircraft piston engine control systems also can realize electronically a good amount of fuel control by the ECU 20. Moreover, when any trouble occurs in the electronic amount of fuel control system, the control valve 11 or the shut-off valve 10 closes the fuel decreasing passage 9 and thus the engine operation at the predetermined rich air-fuel ratio can be carried out.

In the second embodiment, the air-fuel ratio control lever 7 can be omitted. In this case, the fuel regulation device 6 always regulates an amount of fuel so as to realize a predetermined lean air-fuel ratio, according to an amount of intake air. Such aircraft piston engine control systems also can realize electronically a good amount of fuel control by the ECU 20. Moreover, when any trouble occurs in the electronic amount of fuel control system, the control valve 11 or the shut-off valve 10 closes the fuel increasing passage 9' and thus the engine operation at the predetermined lean air-fuel ratio can be carried out.

In the two embodiments, to improve the reliability of ignition, each cylinder can be provided with two ignition plugs. In this case, two high-voltage magnet systems are required but the first and second switches 12*g*, 12*h* may be arranged in only one of the two high-voltage magnet systems. As an engine speed sensor, a high-voltage magnet can be used. Accordingly, the first high-voltage magnet is used as the engine speed sensor 32 which is connected to the ECU 20 and the second high-voltage magnet is used as the engine speed sensor 54 which is connected to the ECU 40, so that if any trouble occurs in one high-voltage magnet, the engine operation can be maintained. Of course, the above-mentioned ideas in the ignition time control can be applicable to a low-voltage magnet system which can be used in the aircraft piston engine.

In the first embodiment, the first limit switch 7*a* is made a limit switch which closes only when the air-fuel ratio control lever 7 is inclined more than the maximum rich air-fuel ratio position. Therefore, all air-fuel ratios can be selected by a manual amount of fuel control. In the second embodiment, the limit switch 7*a'* is made a limit switch which closes only when the air-fuel ratio control lever 7 is inclined more than the maximum lean air-fuel ratio position. Therefore, all air-fuel ratios can be selected by a manual amount of fuel control.

Figure 18:
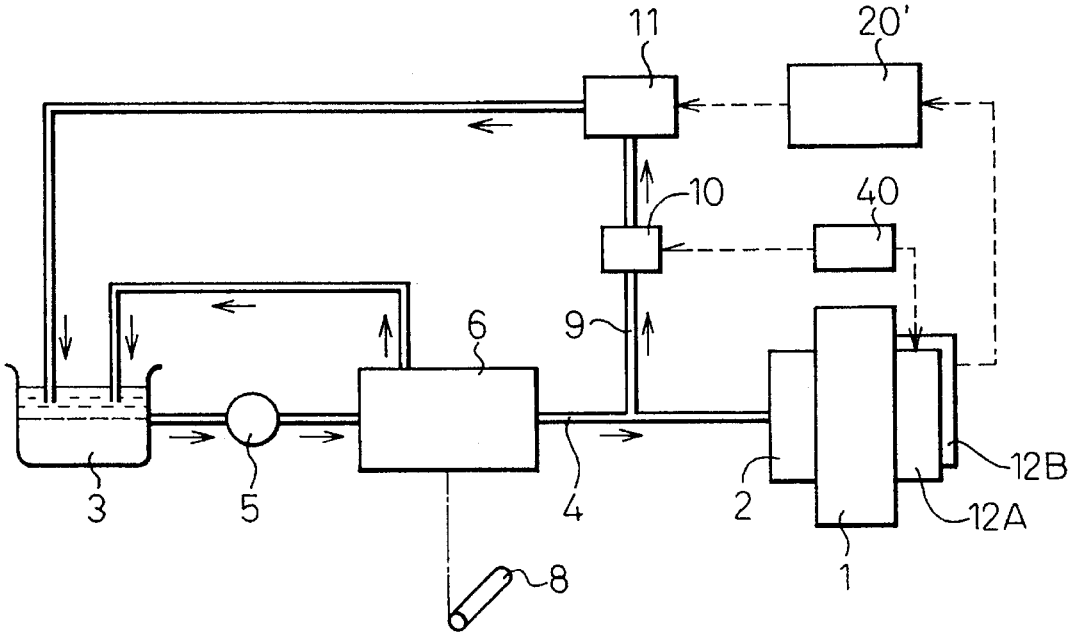
FIG. 18 is a sectional view schematically showing an aircraft piston engine control system, according to the third embodiment of the present invention.
Figure 19:
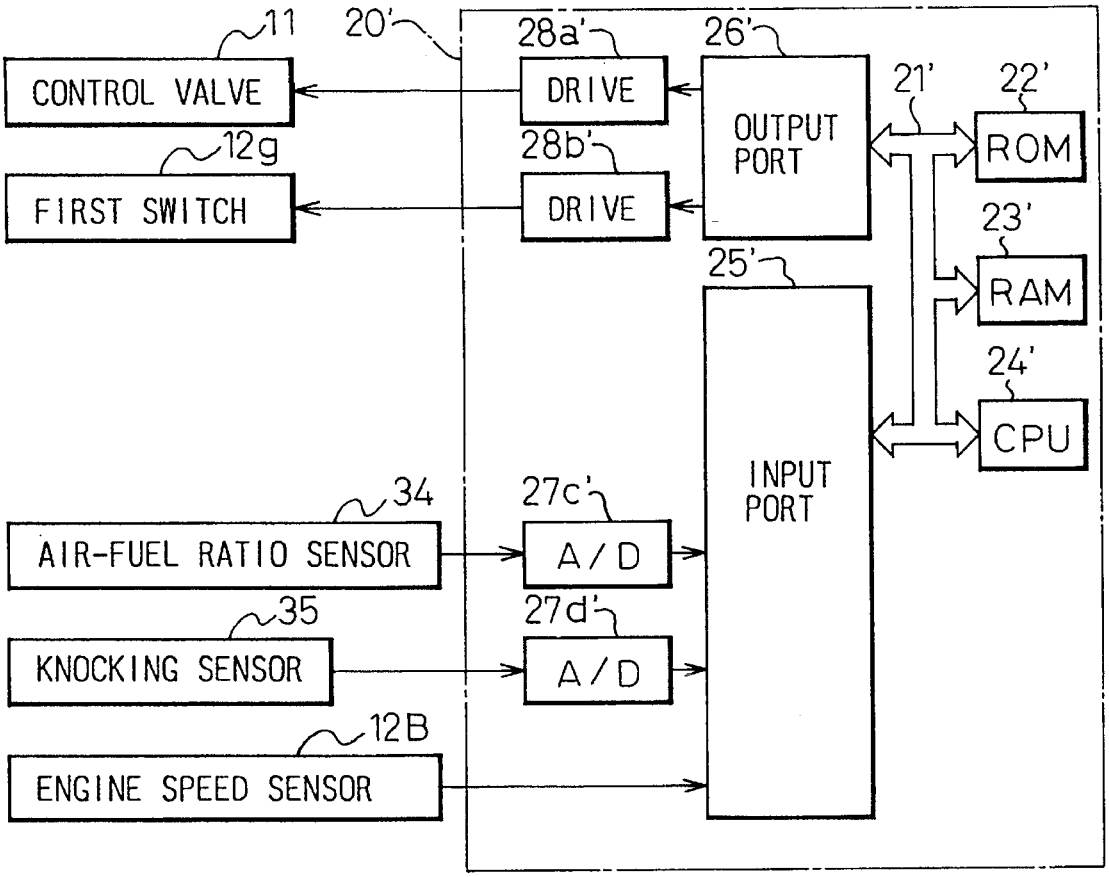
FIG. 19 is a schematic view of the ECU shown in FIG. 18.

FIG. 18 is a view schematically showing an aircraft piston engine control system, according to a third embodiment of the present invention. Only the differences from the first embodiment will be explained. In the present embodiment, a fuel regulation device 6 regulates an amount of fuel so as to always realize a rich air-fuel ratio according to a degree of opening of the throttle valve 51 and supplies it to the fuel delivery valve 2. The air-fuel ratio control lever is omitted. As shown in FIG. 19, an air-fuel ratio sensor 34 which is arranged in the exhaust passage, a knocking sensor 35, and one of two high-voltage magnets 12B as the engine speed sensor are connected to an input port 25' of an ECU 20'. The amount of fuel control is carried out by a feed-back control of the control valve 10 on the basis of a current engine speed (NE) and a current air-fuel ratio (A), according to the third routine shown in FIG. 11. The ignition time control is carried out on the basis of an output of the knocking sensor, according to the second routine shown in FIG. 10.

The other of the two high-voltage magnets 12A is connected to an ECU 40' as a device for detecting any trouble in the electronic control systems. In the aircraft, the blade angle of the propeller is usually variable. In the usual aircraft operation, the blade angle is varied according to the engine load to keep a constant stable engine speed. Accordingly, if a large variation of engine speed is detected by the high-voltage magnet 12A as the engine speed sensor, trouble occurs in the electronic control systems. Accordingly, the shut-off valve 10 and the second switch 12*h* are closed by the ECU 40'. Thus, a good aircraft engine control can be realized by a small number of sensors.

Figure 20:
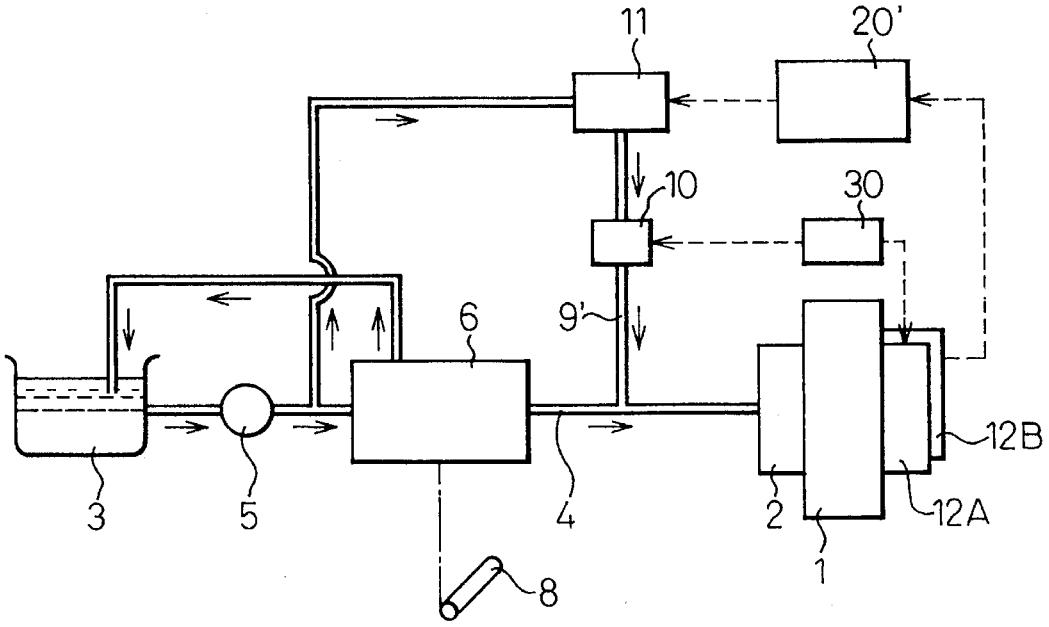
FIG. 20 is a sectional view schematically showing an aircraft piston engine control system, according to the fourth embodiment of the present invention.

FIG. 20 is a view schematically showing an aircraft piston engine control system, according to a fourth embodiment of the present invention. Only the differences from the third embodiment will be explained. In the present embodiment, a fuel regulation device 6 regulates an amount of fuel so as to always realize a lean air-fuel ratio according to a degree of opening of the throttle valve 51 and supplies the fuel to the fuel delivery valve 2. As in the second embodiment, the fuel increasing passage 9' bypasses the fuel regulation device 6 and is connected to the fuel supply passage 4. The amount of fuel control is carried out by a feed-back control of the control valve 10 on the basis of a current engine speed (NE) and a current air-fuel ratio (A), according to the sixth routine shown in FIG. 17. The ignition time control is carried out on the basis of an output of the knocking sensor, according to the second routine shown in FIG. 10. Thus, good aircraft engine control can be realized by a small number of sensors.

In the all embodiments, the electronic control systems are merely added to the prior mechanical control systems. Accordingly, large design changes are not required and thus a high reliable electronic engine control can be realized simply and with low cost.

Although the invention has been described with reference to specific embodiments thereof, it should be apparent that numerous modifications can be made thereto by those skilled in the art, without departing from the basic concept and scope of the invention.

We claim:

1. An aircraft piston engine control system comprising:

a fuel supply passage for supplying fuel to the engine;

a fuel regulation device, which is arranged in said fuel supply passage, and which is linked to a throttle lever, and which regulates an amount of fuel so as to realize a first air-fuel ratio which is more rich than the stoichiometric air-fuel ratio;

a detection means for detecting a current engine operating condition;

a fuel decreasing passage which is connected to said fuel supply passage between said fuel regulation device and the engine; and a fuel decreasing means, which is arranged in said fuel decreasing passage, and which decreases an amount of fuel regulated by said fuel regulation device so as to realize an optimum air-fuel ratio according to the current engine operating condition detected by said detection means.

2. An aircraft piston engine control system comprising:

a fuel supply passage for supplying fuel to the engine;

a fuel regulation device, which is arranged in said fuel supply passage, and which is linked to a throttle lever, and which regulates an amount of fuel so as to realize a second air-fuel ratio which is more lean than the stoichiometric air-fuel ratio;

a detection means for detecting a current engine operating condition;

a fuel increasing passage which is connected to said fuel supply passage between said fuel regulation device and the engine; and a fuel increasing means, which is arranged in said fuel increasing passage, and which increases an amount of fuel regulated by said fuel regulation device so as to realize an optimum air-fuel ratio according to the current engine operating condition detected by said detection means.

3. An aircraft piston engine control system comprising:

a fuel supply passage for supplying fuel to the engine;

a fuel regulation device, which is arranged in said fuel supply passage, and which is linked to a throttle lever and an air-fuel ratio control lever, and which regulates an amount of fuel so as to realize an air-fuel ratio which is designated by said air-fuel ratio control lever;

a detection means for detecting a current engine operating condition;

a fuel decreasing passage which is connected to said fuel supply passage between said fuel regulation device and the engine; and a fuel decreasing means, which is arranged in said fuel decreasing passage, and which decreases an amount of fuel regulated by said fuel regulation device so as to realize an optimum air-fuel ratio according to the current engine operating condition detected by said detection means only when said air-fuel ratio control lever is in the more rich area than a predetermined rich air-fuel ratio.

4. An aircraft piston engine control system comprising:

a fuel supply passage for supplying fuel to the engine;

a fuel regulation device, which is arranged in said fuel supply passage, and which is linked to a throttle lever and an air-fuel ratio control lever, and which regulates an amount of fuel so as to realize an air-fuel ratio which is designated by said air-fuel ratio control lever;

a detection means for detecting a current engine operating condition;

a fuel increasing passage which is connected to said fuel supply passage between said fuel regulation device and the engine; and a fuel increasing means, which is arranged in said fuel increasing passage, and which increases an amount of fuel regulated by said fuel regulation device so as to realize an optimum air-fuel ratio according to the current engine operating condition detected by said detection means only when said air-fuel ratio control lever is in the area more lean than a predetermined lean air-fuel ratio.

5. An aircraft piston engine control system according to claim 1, wherein said fuel decreasing means has an air-fuel ratio sensor arranged in the exhaust passage of the engine and carries out a feed-back control of an amount of fuel regulated by said fuel regulation device so as to realize the optimum air-fuel ratio, on the basis of an output of said air-fuel ratio sensor.

6. An aircraft piston engine control system according to claim 3, wherein said fuel decreasing means has an air-fuel ratio sensor arranged in the exhaust passage of the engine and carries out a feed-back control of an amount of fuel regulated by said fuel regulation device so as to realize the optimum air-fuel ratio, on the basis of an output of said air-fuel ratio sensor.

7. An aircraft piston engine control system according to claim 2, wherein said fuel increasing means has an air-fuel ratio sensor arranged in the exhaust passage of the engine and carries out a feed-back control of an amount of fuel regulated by said fuel regulation device so as to realize the optimum air-fuel ratio, on the basis of an output of said air-fuel ratio sensor.

8. An aircraft piston engine control system according to claim 4, wherein said fuel increasing means has an air-fuel ratio sensor arranged in the exhaust passage of the engine and carries out a feed-back control of an amount of fuel regulated by said fuel regulation device so as to realize the optimum air-fuel ratio, on the basis of an output of said air-fuel ratio sensor.

9. An aircraft piston engine control system according to claim 1, further comprising a detection means for detecting any trouble in said fuel decreasing means, and a shut-off means for shutting-off said fuel decreasing passage when said detection means detects any trouble.

10. An aircraft piston engine control system according to claim 3, further comprising a detection means for detecting any trouble in said fuel decreasing means, and a shut-off means for shutting-off said fuel decreasing passage when said detection means detects any trouble.

11. An aircraft piston engine control system according to claim 5, further comprising a detection means for detecting any trouble in said fuel decreasing means, and a shut-off means for shutting-off said fuel decreasing passage when said detection means detects any trouble.

12. An aircraft piston engine control system according to claim 6, further comprising a detection means for detecting any trouble in said fuel decreasing means, and a shut-off means for shutting-off said fuel decreasing passage when said detection means detects any trouble.

13. An aircraft piston engine control system according to claim 2, further comprising a detection means for detecting any trouble in said fuel increasing means, and a shut-off means for shutting-off said fuel increasing passage when said detection means detects any trouble.

14. An aircraft piston engine control system according to claim 4, further comprising a detection means for detecting any trouble in said fuel increasing means, and a shut-off means for shutting-off said fuel increasing passage when said detection means detects any trouble.

15. An aircraft piston engine control system according to claim 7, further comprising a detection means for detecting any trouble in said fuel increasing means, and a shut-off means for shutting-off said fuel increasing passage when said detection means detects any trouble.

16. An aircraft piston engine control system according to claim 8, further comprising a detection means for detecting any trouble in said fuel increasing means, and a shut-off means for shutting-off said fuel increasing passage when said detection means detects any trouble.

17. An aircraft piston engine control system according to claim 9, wherein said detection means for detecting any trouble is separated from said detection means for detecting a current engine operating condition.

18. An aircraft piston engine control system according to claim 10, wherein said detection means for detecting any trouble is separated from said detection means for detecting a current engine operating condition.

19. An aircraft piston engine control system according to claim 11, wherein said detection means for detecting any trouble is separated from said detection means for detecting a current engine operating condition.

20. An aircraft piston engine control system according to claim 12, wherein said detection means for detecting any trouble is separated from said detection means for detection a current engine operating condition.

21. An aircraft piston engine control system according to claim 13, wherein said detection means for detecting any trouble is separated from said detection means for detecting a current engine operating condition.

22. An aircraft piston engine control system according to claim 14, wherein said detection means for detecting any trouble is separated from said detection means for detecting a current engine operating condition.

23. An aircraft piston engine control system according to claim 15, wherein said detection means for detecting any trouble is separated from said detection means for detecting a current engine operating condition.

24. An aircraft piston engine control system according to claim 16, wherein said detection means for detecting any trouble is separated from said detection means for detecting a current engine operating condition.

25. An aircraft piston engine control system according to claim 1, further comprising a shut-off means for shutting-off said fuel decreasing passage when said throttle lever is in the area of higher engine load than a predetermined engine load.

26. An aircraft piston engine control system according to claim 3, further comprising a shut-off means for shutting-off said fuel decreasing passage when said throttle lever is in the area of higher engine load than a predetermined engine load.

27. An aircraft piston engine control system according to claim 5, further comprising a shut-off means for shutting-off said fuel decreasing passage when said throttle lever is in the area of higher engine load than a predetermined engine load.

28. An aircraft piston engine control system according to claim 6, further comprising a shut-off means for shutting-off said fuel decreasing passage when said throttle lever is in the area of higher engine load than a predetermined engine load.

29. An aircraft piston engine control system according to claim 1, further comprising a shut-off means for shutting-off said fuel decreasing passage when the current engine speed is low.

30. An aircraft piston engine control system according to claim 3, further comprising a shut-off means for shutting-off said fuel decreasing passage when the current engine speed is low.

31. An aircraft piston engine control system according to claim 5, further comprising a shut-off means for shutting-off said fuel decreasing passage when the current engine speed is low.

32. An aircraft piston engine control system according to claim 6, further comprising a shut-off means for shutting-off said fuel decreasing passage when the current engine speed is low.

33. An aircraft piston engine control system comprising:

a normally-closed breaker which is mechanically opened to synchronize to the crank shaft so as to generates a high-voltage for ignition;

a normally-closed first switch connected to said breaker in series;

a detection means for detecting a current engine operating condition; and a first switch control means which opens said first switch at an optimum ignition time according to the current engine operating condition detected by said detection means before said breaker is opened.

34. An aircraft piston engine control system comprising:

a normally-closed breaker which is mechanically opened to synchronize to the crank shaft so as to generates a high-voltage for ignition;

a normally-closed first switch connected to said breaker in series;

a knocking sensor for detecting knocking in at least one cylinder of the engine; and a first switch control means which carries out a feed-back control of said first switch so as to open said first switch at knocking limit on the basis of an output of said knocking sensor.

35. An aircraft piston engine control system according to claim 33, further comprising;

a normally-open second switch connected to said first switch in a row;

a detection means for detecting any trouble in said first switch control means;

a second switch control means which closes said second switch when said detection means detects any trouble.

36. An aircraft piston engine control system according to claim 34, further comprising;

a normally-open second switch connected to said first switch in a row;

a detection means for detecting any trouble in said first switch control means;

a second switch control means which closes said second switch when said detection means detects any trouble.

* * * * *

UNITED STATES PATENT AND TRADEMARK OFFICE

CERTIFICATE OF CORRECTION

PATENT NO. : 5,577,487

DATED : November 26, ]996

INVENTOR(S) : Yukio OHTAKE, et al.

It is certified that error appears in the above-indentified patent and that said Letters Patent is hereby corrected as shown below:

Column 2, line 12, delete the hyphen between "normally" and "closed".

Column 2, line 14, delete the hyphen between "high" and "voltage" and "normally" and "closed".

Column 3, lines 52 and 53, delete the hyphen between "normally" and "open".

Column 4, line 6, delete the hyphen between "normally" and "closed".

Column 5, line 17, between "cylinders," and "fuel" insert --and--.

Column 6, line 35, change "(0)" to --0--.

Column 6, line 41, change "(0)" to --0--.

Column 8, line 11, change "that" to --if--.

Column 8, line 48, change "(0)" to --0--.

Column 10, line 14, change "high" to --highly--.

UNITED STATES PATENT AND TRADEMARK OFFICE

CERTIFICATE OF CORRECTION

PATENT NO. : 5,577,487

DATED : November 26, 1996

INVENTOR(S) : Yukio OHTAKE, et al.

It is certified that error appears in the above-indentified patent and that said Letters Patent is hereby corrected as shown below:

Column 13, line 34, delete the hyphen between "normally" and "closed".

Column 13, line 37, delete the hyphen between "normally" and "closed".

Column 14, line 9, delete the hyphen between "normally" and "closed".

Column 14, line 12, delete the hyphen between "normally" and "closed".

Column 14, line 22, delete the hyphen between "normally" and "open".

Signed and Sealed this

Ninth Day of September, 1997

*Attest:*

*Attesting Officer*

Bruce Lehman

BRUCE LEHMAN

*Commissioner of Patents and Trademarks*